United States Patent [19]

Brewer

[11] 3,977,531

[45] Aug. 31, 1976

[54] STIFF-LEG CRANE

[75] Inventor: Jack J. Brewer, Grapevine, Tex.

[73] Assignee: Sam P. Wallace Company, Inc., Dallas, Tex.

[22] Filed: Mar. 3, 1975

[21] Appl. No.: 554,483

Related U.S. Application Data

[63] Continuation-in-part of Ser. No. 356,995, May 3, 1973, abandoned.

[52] U.S. Cl. ..... 212/59 R; 212/145; 212/28; 212/48; 52/114

[51] Int. Cl.[2] ..... B66C 23/06

[58] Field of Search ..... 212/28, 35 R, 59 R, 212/12, 17, 29, 48, 58, 145; 52/114, 120–121; 37/69, 198

[56] References Cited

UNITED STATES PATENTS

| | | | |
|---|---|---|---|
| 220,031 | 9/1879 | Meyer et al. | 52/114 |
| 248,938 | 11/1881 | Loveridge | 212/35 R |
| 2,345,253 | 3/1944 | Funk | 52/120 |
| 2,436,799 | 3/1948 | Frost | 212/145 |
| 2,694,474 | 11/1954 | Meany | 52/114 |
| 2,961,102 | 11/1960 | Pitman | 212/145 |
| 3,148,778 | 9/1964 | Fox et al. | 212/58 R |
| 3,167,188 | 1/1965 | Burgess | 212/145 |
| 3,209,920 | 10/1965 | DeCuir | 212/59 R |
| 3,302,345 | 2/1967 | Ballantine | 52/121 |
| 3,802,575 | 4/1974 | Ingram et al. | 212/35 R |

FOREIGN PATENTS OR APPLICATIONS

| | | | |
|---|---|---|---|
| 449,789 | 3/1913 | France | 52/121 |

*Primary Examiner*—Robert J. Spar
*Assistant Examiner*—R. B. Johnson
*Attorney, Agent, or Firm*—H. Mathews Garland

[57] ABSTRACT

A stiff-leg crane for use in handling loads in the erection of buildings and the like, including a base rotatable 360° on a bearing, a vertical mast rigidly mounted at a lower end at the center of rotation of the base, a boom pivoted at a foot end along one end of the base, boom support and load handling lines from the top of the mast to the boom, a pair of adjustable lay leg mast braces for boom and mast support from either the crane base or the structure being erected by the crane, and means for securing the lower free ends of the lay legs to either the base or the structure being erected. The lay legs are adjustable both in length and the angle between the lay legs and the mast. Additionally the lay legs are fully rotatable 360° about the mast and may swing between the mast and the boom for relocation from one side of the mast to the other without interference with the boom or the boom support and load handling lines. The lay legs are securable to the crane base for jumping the crane and when handling loads close to the crane base. Sills are connectible between the crane base and the lower free ends of the lay legs when structural rigidity requires.

9 Claims, 12 Drawing Figures

STIFF-LEG CRANE

RELATED APPLICATION

This application is a continuation-in-part of my application, Ser. No. 356,995, filed May 3, 1973, now abandoned, entitled STIFF-LEG CRANE.

This invention relates to cranes and more particularly relates to stiff-leg type cranes.

Available cranes of the stiff-leg type generally have self-aligning base mounting apparatus for the mast and stiff-leg mast braces and sills of fixed length together with mast and boom bracing and handling structure which precludes ready relocation of the mast braces for operation of the boom in a full circle around the crane base. Further, such conventional cranes cannot be climbed or jumped along the parent structure or a self-erecting climbing tower without tearing down and reassembling the crane at each new operational level.

It is therefore a principal object of the invention to provide a new and improved stiff-leg type crane.

It is another object of the invention to provide a stiff-leg type crane having a mast rigidly mounted in a self-supporting fashion on a rotatable base supporting the lower end of the boom.

It is another object of the invention to provide a stiff-leg crane having mast braces which are adjustable in length and locatable at any desired angular position relative to the mast and at various locations within the circle around the mast.

It is another object of the invention to provide a stiff-leg crane having a mast braced by adjustable lay legs which may be secured to the crane base for working loads close to the base and also may be secured at substantial distances from the crane base to supporting structure such as a tower or a building being erected by the crane for the handling of greater loads from the boom.

It is another object of the invention to provide adjustable mast bracing lay legs which may be moved to selected positions around the crane base from one side of the boom to the other without disassembling the crane.

It is another object of the invention to provide a stiff-leg type crane which may be jumped or climbed in a self-erecting type supporting tower or along the parent structure being erected with the crane.

In accordance with the invention there is provided a stiff-leg type crane mounted on a rotatable base and including a vertical mast rigidly secured in a self-supporting manner to a rotatable crane base and further including mast braces of the lay leg type which are each rotatable to any position in a circle about the mast, are adjustable in vertical planes relative to the mast, may be moved from one side of the boom to the other between the boom, the mast, and the crane base, and may be secured to either the crane base for climbing the crane and supporting loads close to the base or may be secured outwardly from the base to support structure such as the parent structure being erected with the crane. The boom is pivotally connected along one end of the rotatable crane base and may be raised and lowered to various load handling positions by load handling and boom support lines connected between the top of the mast and the boom. Each of the lay legs is pivoted at an upper end to the upper end of the mast and adjustable in length to permit the lay leg to be retracted and folded close to the mast for relocation between opposite sides of the boom. Sills are connectible between the lower free ends of the lay legs and the crane base support when the structure supporting the crane provides inadequate rigidity and strength for connection of the lay legs to support the mast. The crane is foldable to occupy minimum space and area in a horizontal plane for self-support of the crane during climbing or lowering of the crane in a self-erecting tower for supporting the crane independent of the structure being erected with the crane.

The foregoing objects and advantages will be better understood from the following detailed description of preferred embodiments of a stiff-leg type crane constructed in accordance with the invention taken in conjunction with the accompanying drawings wherein.

Figure 1:
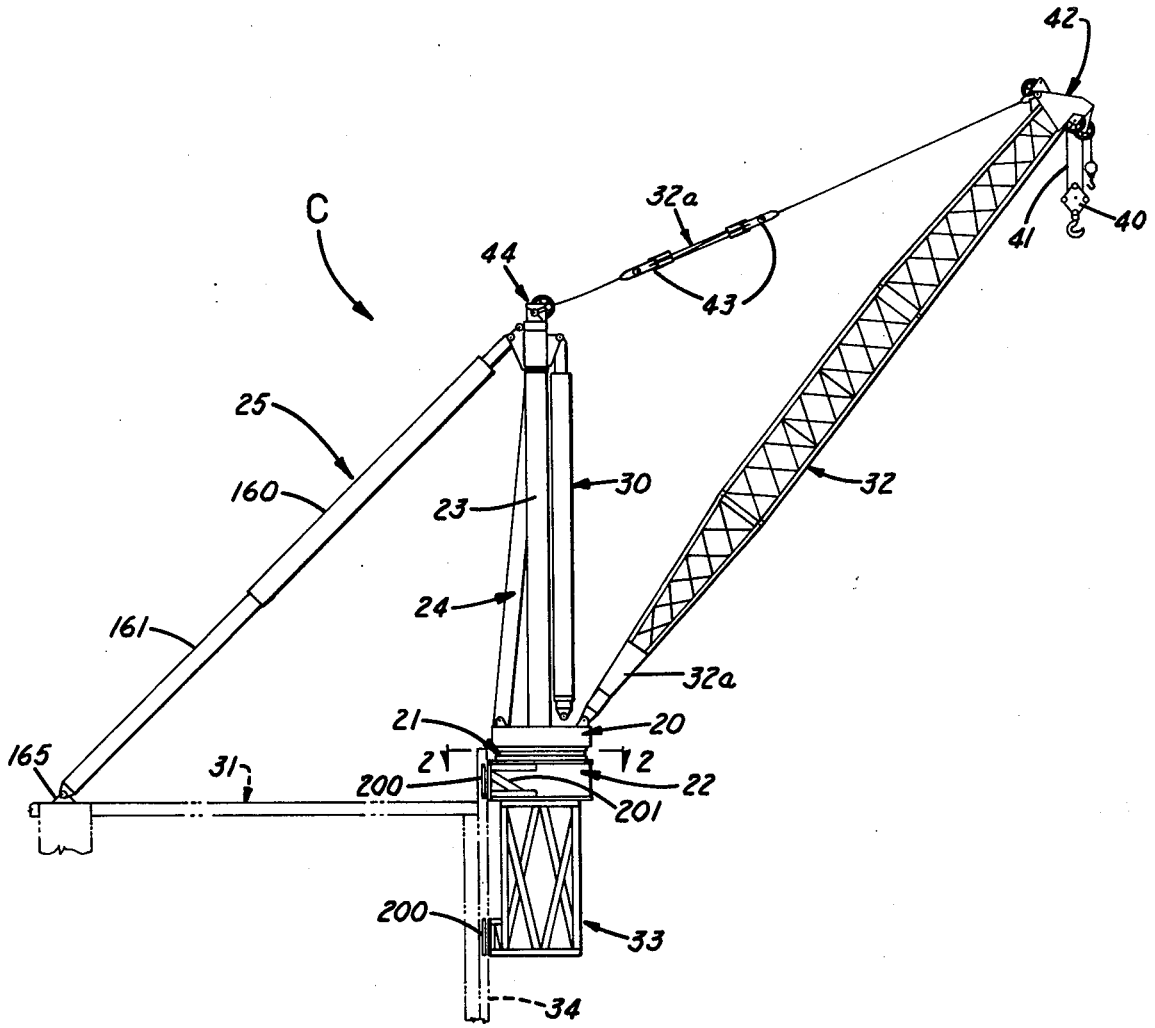
FIG. 1 is a side view in elevation showing the crane in one operating position on a parent structure during relocation of one of the lay leg mast braces.

Referring to FIG. 1 a crane C embodying the features of the invention includes a crane base 20 mounted on a ring-shaped thrust bearing 21 supported on a cylindrical collar 22. The crane has a vertical mast 23 supported at a lower or foot end in the base 20 located with the longitudinal axis of the mast aligned with the axis of rotation of the base. An angular mast brace 24 is secured between the upper end of the mast and a rear or back end of the base 20. Adjustable and rotatable lay legs 25 and 30 are provided for additional mast support or bracing from either the rear end of the platform 20 or from a portion of a parent structure 31 being erected with the frame. A boom 32 is pivotally connected at a foot or lower end to the forward end of the platform 20. The boom is supported and manipulated by a line assembly 32 connected between the upper free end of the boom and the upper end of the mast for raising and lowering the boom and for handling loads from the free end of the boom. The foot of the mast is secured sufficiently rigidly with the crane base 20, as described in detail hereinafter, to permit relocation of the lay legs as desired and operation of the crane with the lay legs tied off to the base during handling of loads close to the base and the climbing of the crane. In FIG. 1 the crane is shown mounted on a subframe 33 which may be raised and lowered along guide rails 34 secured along the parent structure 31. As illustrated in FIG. 1 the lay leg 30 is retracted and folded closely along the mast 23 for relocation of the lay leg from one side of the boom 32 to the other side of the boom when changing the arc of the circle of operation of the boom such as when changing operation of the crane from one arc of substantially 270° around the boom base to another arc of substantially 270°.

When fully rigged and ready for operation as shown in FIG. 1 the crane includes a load block 40 supported from a load line 41 extending over a boom point block assembly 42. The line assembly for manipulating the angle of the boom includes topping blocks 43 connected with crown block assembly 44 mounted on the top of the mast 23.

Figure 3:
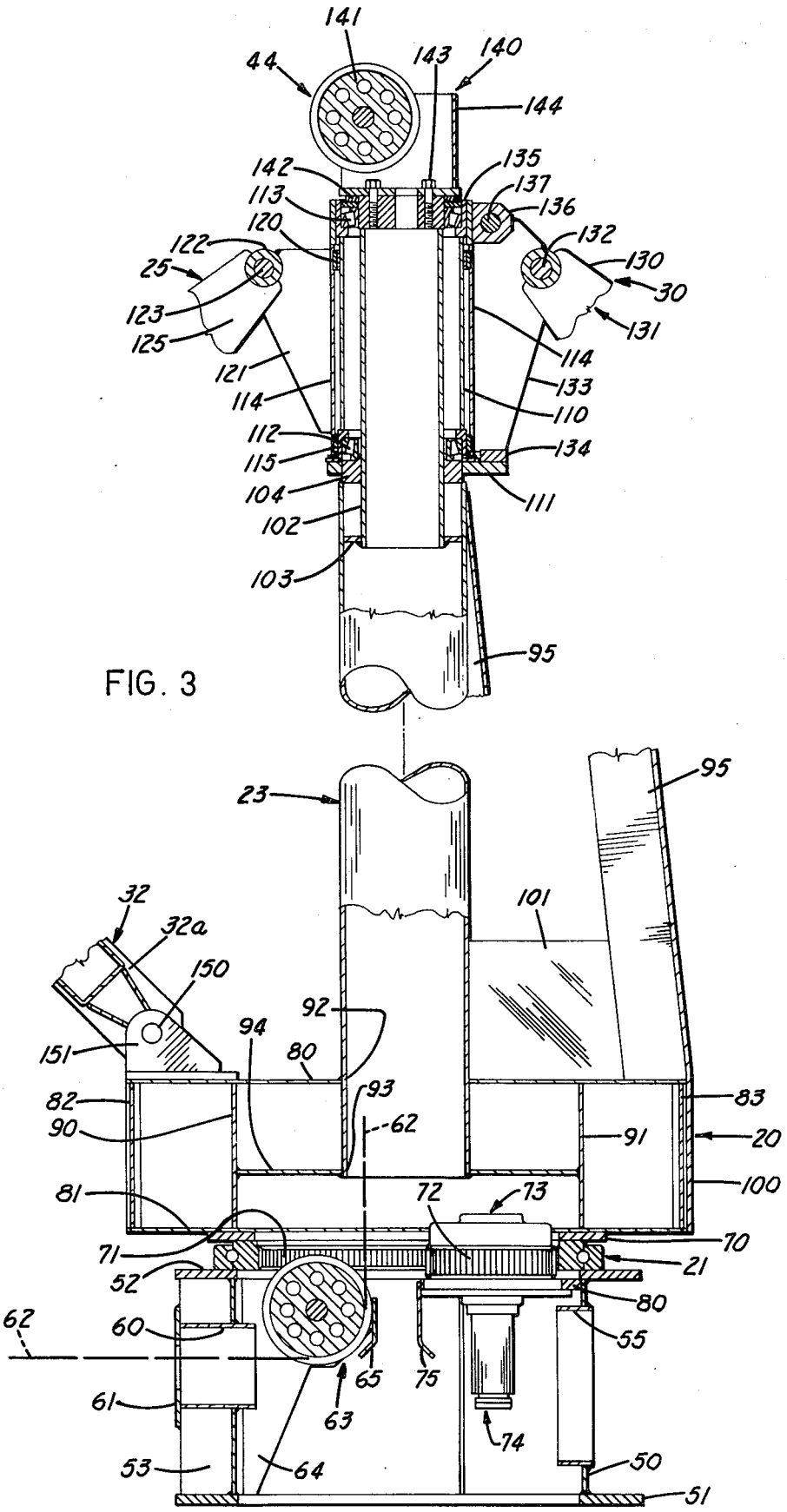
FIg. 3 is a broken fragmentary enlarged side view in section and elevation showing the details of the crane base, mast foot and boom foot, and mast head.
Figure 4:
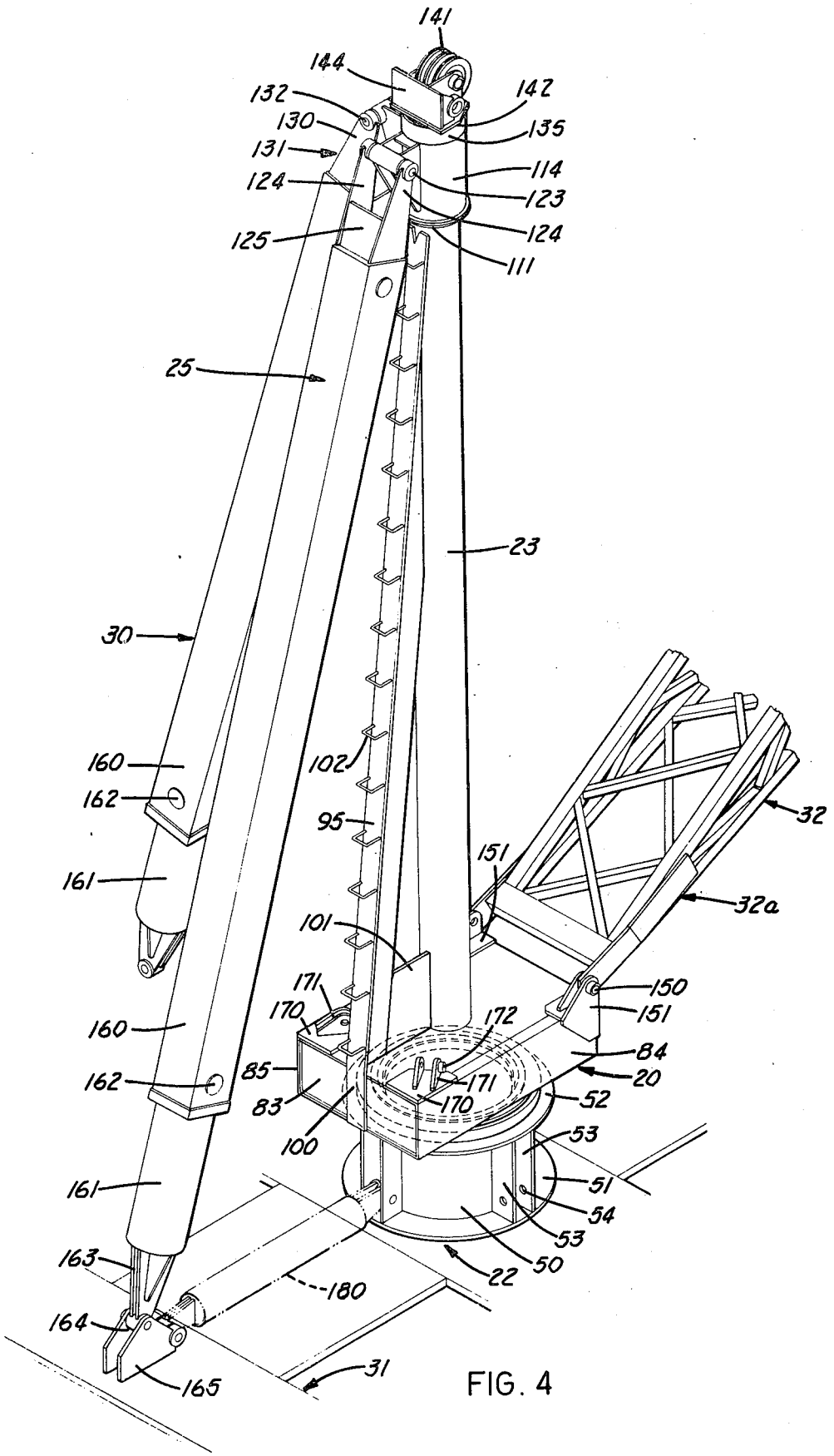
FIG. 4 is a fragmentary perspective view showing the crane in a condition for handling loads a substantial distance from the base and illustrating one of the lay legs connected with a parent structure and an additional supporting sill running from the lay leg to the crane base assembly.

Referring to FIGS. 3 and 4 the bearing collar assembly 22 is a generally cylindrical housing formed by a cylindrical member 50 secured between a lower annular flange 51 and an upper annular flange 52. Vertical parallel spaced reinforcing flanges or webs 53 are secured in pairs around the cylindrical member 50 extending between the inner upper and lower faces, respectively, of the flanges 51 and 52. Each of the webs 53 has a hole 54 for connection of the inward end of one of the sills required in certain installations of the crane as discussed hereinafter. As shown in FIG. 3 an annular flange 55 secured in the housing member 50 defines a manhole for access into the bearing collar assembly. On an opposite side of the bearing collar assembly a smaller cylindrical member 60 provided with an outer flange 61 is secured through the housing member 50 defining another opening into the bearing collar assembly for access of lines 62 which may include load handling and boom control lines. The lines 62 run over a sheave assembly 63 secured with spaced plates or support members 64 within the housing member 50 to permit horizontal entry of the lines 62 and direct the lines upwardly into the open lower end of the mast 23. A plate 65 mounted adjacent to the sheave assembly 63 holds the lines 62 on the sheaves of the assembly.

The boom base 20 is rotatably mounted on an annular plate 70 supported on the thrust bearing 21 which is secured on the top face of the upper flange 52 of the collar assembly 22. The thrust bearing 21 is a suitable standard ball type thrust bearing such as a Series 3000 ROTEK No. A12-45N6B. The thrust bearing includes an internal ring gear 71 formed on the inner race of the thrust bearing. The ring gear 71 meshes with a pinion gear 72 of a slew ring drive unit such as a LOWRENCE No. 3202-0130. The drive unit 73 is suitably secured within the housing 50 of the collar assembly 22 so that the slew ring drive unit is positioned within the ring gear of the thrust bearing for rotating the ring gear and inner race of the thrust bearing to turn the mounting plate 70 of the crane base 20. A motor 74 is connected with the slew ring drive unit to power the drive unit. The drive unit is supported from the transverse mounting plate 75 and the flange 80 within the collar assembly housing 50.

The crane base 20 is a rectangular box-shaped member having top and bottom panel members 80 and 81, respectively, end members 82 and 83, and sides 84 and 85. Internally the base is strengthened by lateral partitions 90 and 91 which extend across the base housing between the sides and vertically between the top and bottom panels.

The mast 23 is rigidly secured at the foot or lower end of the mast into the crane base 20 as shown in FIG. 3. The mast extends through a hole 92 in the top panel 80 of the crane base and through a hole 93 in a horizontal internal bracing plate 94 which is secured within the housing 20 extending laterally between the sides 84 and 85 and longitudinally between the internal partitions 90 and 91 of the crane base. The mast foot is welded to the panels 80 and 94. The mounting of the mast 23 with the crane base 20 is further strengthened by an angular T beam 95 secured at a lower end with the base 20 as shown in the lower portion of FIG. 3 and with the upper portion of the mast as shown in the upper section of FIG. 3. The lower end portion of the angular brace 95 is formed so that a flange portion 100 extends downwardly along the end 83 of the base 20 as evident in both FIGS. 3 and 4. A vertical web plate 101 is connected between the top face of the base of the top plate 80 of the base 20 between the mast 23 and the inner vertical edge of the T brace 95. Spaced ladder rungs 102 are secured along the outer face of the T brace 95 to permit a workman to climb the mast for servicing the upper ends of the lay legs and the crown block. The connection of the foot of the mast into the crane base in the manner described and illustrated provides a substantially rigid mast which enables the crane to function within certain weight limits without the assistance of the lay legs or with the lay legs closely tied into the base in contrast with self-aligning mast mountings in presently available conventional stiff-leg cranes.

The construction of the upper end of the mast 23 along with the swivel connection of the upper ends of the lay legs with the mast are illustrated in detail in the upper portion of FIG. 3. A reduced separate upper end mast section 102 is secured with a lower annular internal flange 103 and an upper flange and bearing support 104 secured into the upper end of the mast 23. The upper end of the reduced mast section 102 is closed by a plug member 105. A swivel tube 110 fits around the upper mast section 102 above a thrust washer 111. A lower tapered roller bearing 112 is fitted within the swivel tube 110 between the swivel tube and the mast section 102. Similarly, an upper tapered roller bearing 113 is fitted around the plug 105 within the upper end of the swivel tube 110. The upper and lower tapered roller bearings permit the mast to rotate as the boom swings with the base 20 relative to the fixed lay legs 25 and 30. A swivel housing 114 is fitted around the swivel tube 110 for rotatably supporting the upper end of the lay leg 25. Bushing rings 115 and 120 are fitted between the swivel tube 110 and the swivel housing 114 so that the housing may rotate relative to the swivel tube. A bracket 121 is secured on the swivel housing 114 for connection of the upper end of the lay leg 25 with the housing 114. The bracket 121 has a sleeve 122 which receives a pin 123 extending through spaced members 124 on a bifurcated upper end bracket 125 on the lay leg 25. The other lay leg 30 has similar spaced upper end members 130 on a bifurcated upper end bracket member 131 on the lay leg 30 connected by a pin 132 with a bracket portion 133 connected at a lower end 134 with the thrust washer 111 and at the upper end with a swivel ring 135 fitted around the upper bearing 113. The ring 135 is engaged around the outer race of the bearing 113. Thus the upper ends of the lay legs are connected in a manner which permits the legs to pivot upwardly and downwardly in a vertical plane while being rotatable horizontally about the upper end portion of the mast. The bearings 112 and 113 permit the mast to rotate relative to the upper ends of the lay legs when the lay legs are secured for providing additional mast support. The bracket 133 on the upper end of the lay leg 30 has sleeve portions 136 secured by a pin 137 to similar sleeve portions on the ring 135.

The crown block assembly 44 includes a crown block 140 supporting a plurality of sheaves 141. The crown block has a bottom plate 142 secured by bolts 143 to the top face of the closure plug 105 on the mast. The crown block has a back plate 144 which aids in keeping the various boom and load handling lines on the sheaves in the crown block.

The boom foot 32*a* is bifurcated as shown in FIG. 4 and secured by pins 150 to spaced brackets 151 mounted on the forward end of the crane base 20 so that the crane may pivot horizontally between a substantially vertical position close to the mast and a position which may move below the horizontal in the opposite lower direction.

Figure 5:
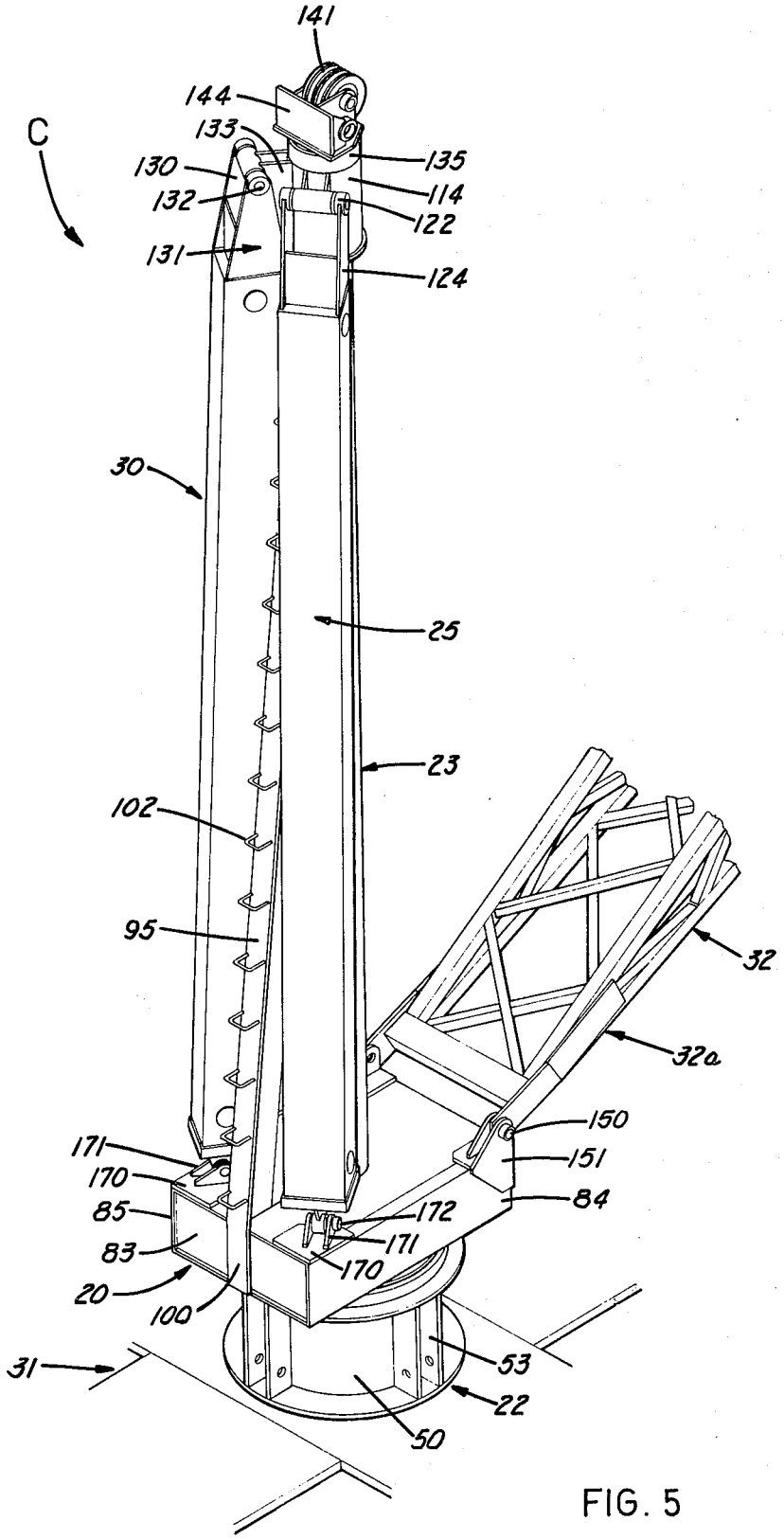
FIG. 5 is a perspective fragmentary view similar to FIG. 4 showing the lay legs secured at lower ends to the crane base for handling light loads at a distance from the crane base and heavier loads close in to the crane base and for climbing the crane.
Figure 12:
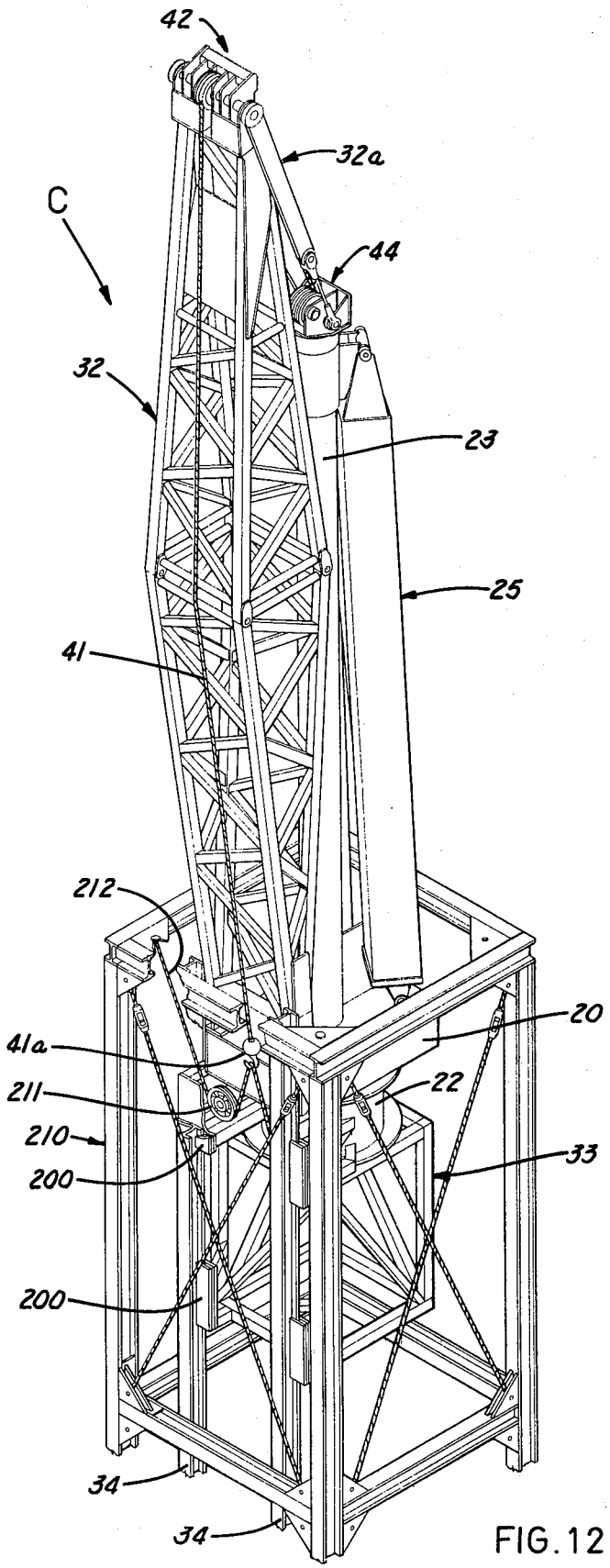
FIG. 12 is a perspective view of the crane being raised or climbing in a self-supporting, self-erecting tower.

Each of the lay legs is a longitudinally adjustable telescoping assembly comprising an outer housing section 160 and an inner movable section 161. The inner section is selectively positioned relative to the outer section by a pin 162 which engages any one of a plurality of holes provided spaced along the inner section so that the total length of the lay leg is readily adjusted. Each lay leg has an end bracket 163 provided with a sleeve 164 which is pinned either to the structure being erected by the crane or to the crane base depending upon operating conditions. When securing to the parent structure is desired brackets 165 comprising spaced plates are secured at the desired location on the parent structure as illustrated in FIG. 4. The back end of the base 20 of the crane has a pair of brackets 170 having spaced vertical plates 171 provided with holes to receive pins 172 which pass through the sleeves 164 on the lower ends of the lay legs to secure the lay legs at the lower ends thereof to the crane base when loads are handled close in to the mast and crane base and when climbing the crane as illustrated in FIGS. 5 and 12.

If the parent structure cannot tolerate forces applied to the lay leg without additional support a sill 180 may be connected between the lower end of the lay legs and the collar assembly 20. Under such circumstances the sill is connected between the brackets 53 of the collar assembly and the bracket 165 on the parent structure so that downward forces on the lay leg are resisted by the sill 180 which connects back with the base support structure of the crane. Since the sill 180 is connected with the collar assembly rotation of the crane base and boom are not impaired.

A particularly improved feature of the present invention is the capability of each of the lay legs to be retracted and folded inwardly to a position close to the mast 23 so that the lay leg may pass around the mast beneath the boom rigging across the base of the crane within the foot of the boom. For retracting each lay leg the pin 163 is withdrawn, the inner section 161 of the lay leg is telescoped upwardly farther into the outer housing section 160 and the pin 162 is replaced to hold the lay leg retracted. This operation may be readily carried out by maneuvering the boom 32 around to within the vicinity of the particular lay leg being adjusted until the boom with the line 41 is sufficiently close to the mast for the load handling lines to be connected to the lower end 163 of the lay leg to pull the inner portion of the lay leg upwardly. The only limitation on the rotation of the lay legs relative to the mast is that one of the lay legs cannot pass the other due to the nature of the connection of the upper ends of the lay legs with the mast as evident from the previous description of such structure.

In the particular form of the crane illustrated and described the lines extending to the boom for manipulating the boom and handling loads pass upwardly through the open lower end of the mast 22 from the sheave assembly 63 within the collar assembly 22 and out of the open upper end of the mast over the sheave assembly 141. Such an arrangement permits the mast and crane base to rotate sufficiently without fouling the lines. The specific structure of the boom tip block assembly 42 and the various lines connected with the boom are conventional in structure and arrangement and form no part of the present invention. While it is preferred that the boom lines run through the mast it will be recognized that the lines could readily be arranged to go directly from a winch to the crown block 44 without passing through the mast and thus under such an alternate form the mast could be solid.

In operation of the crane under conditions where the lay legs are extended and secured to the parent structure being erected with the crane or possibly an independent tower supporting the crane it is preferred that the lay legs be connected with such crane supporting structure spaced apart 90° from each other so that both legs cooperate to provide maximum support for the mast and boom at any position of operation of the boom within approximately 270° around the mast within the circle of operation of the crane.

Figure 6:
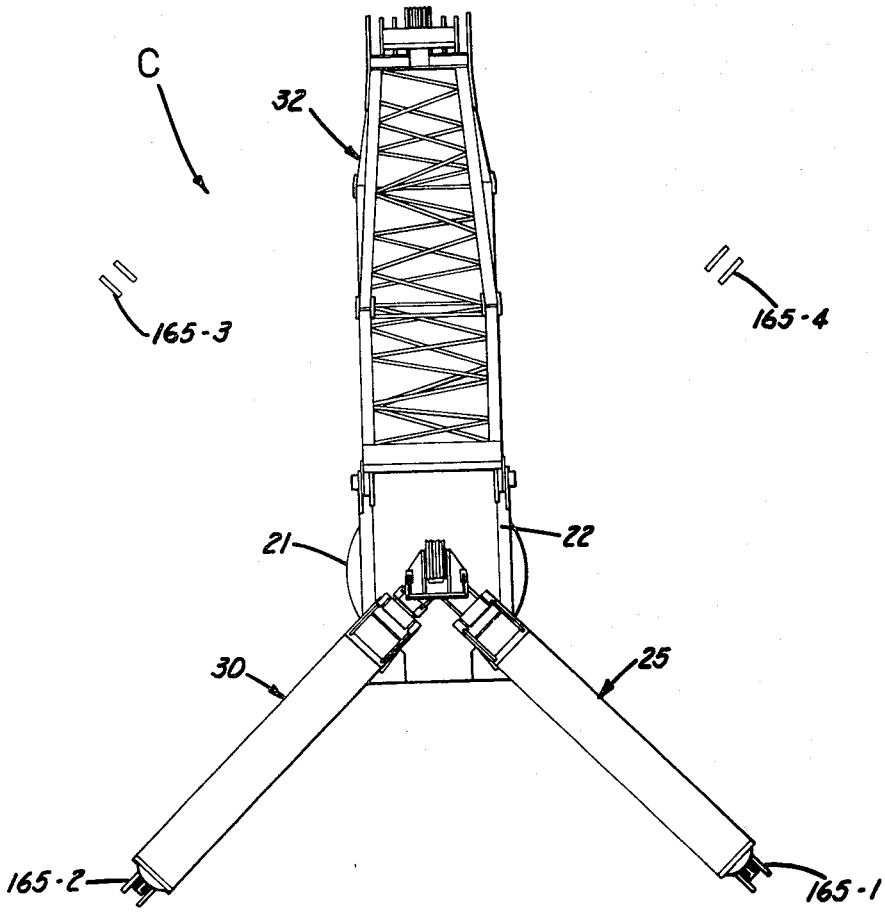
FIG. 6 is a top plan view of the crane connected with a parent structure at one selected arc of boom operation.
Figure 7:
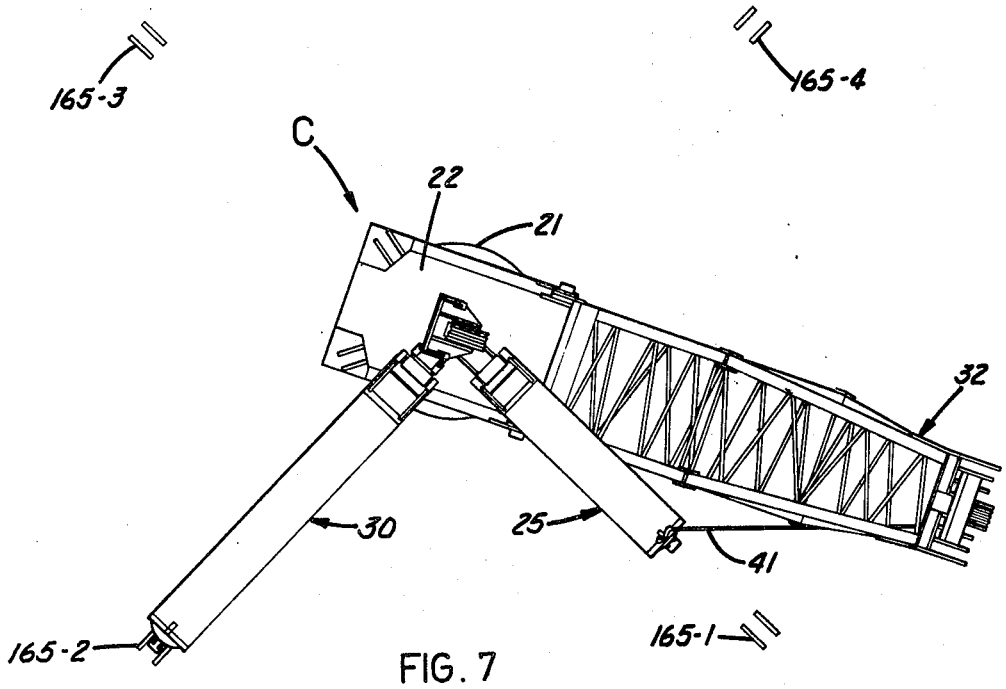
FIG. 7 is a top plan view similar to FIG. 6 showing a first step in the relocation of a first of the lay legs to permit the boom to operate in another arc around the crane base.
Figure 8:
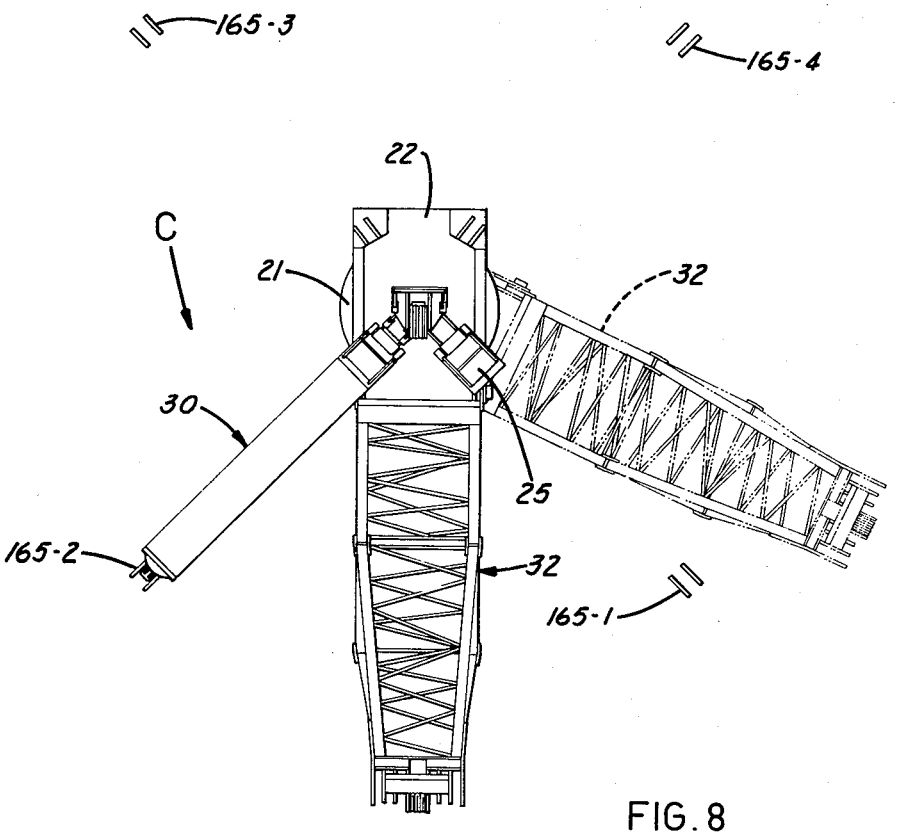
FIG. 8 is a top plan view similar to FIG. 7 showing the first lay leg folded against the mast and the boom rotated clockwise past the lay leg for engagement with the lay leg to rotate it to the new position.
Figure 9:
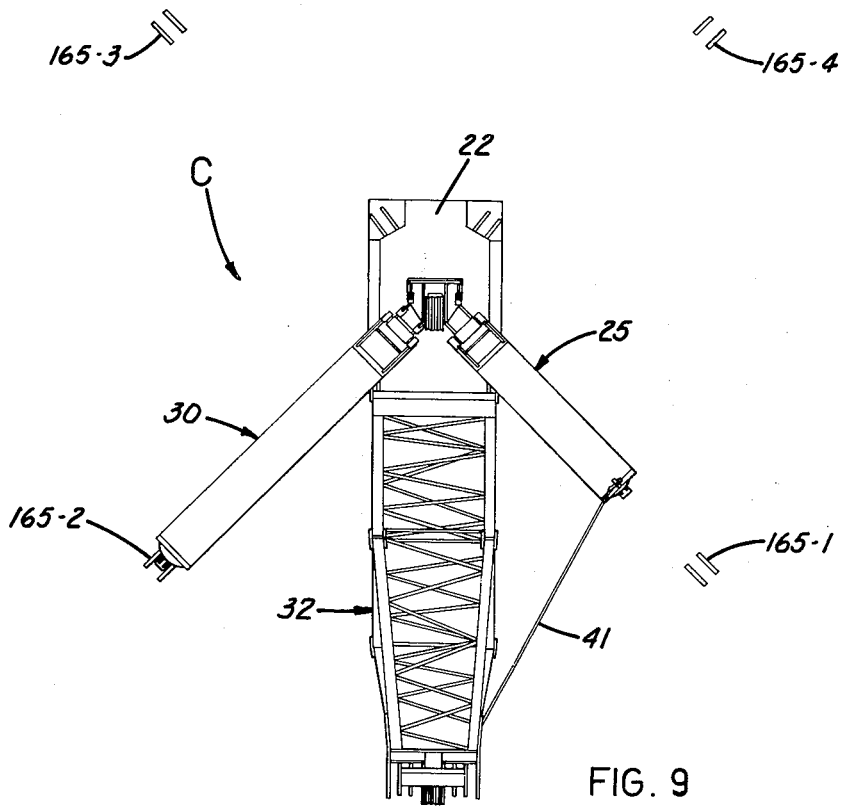
FIG. 9 is a top plan view similar to FIG. 8 showing the boom engaged with the lay leg preparatory to moving the lay leg counterclockwise.
Figure 10:
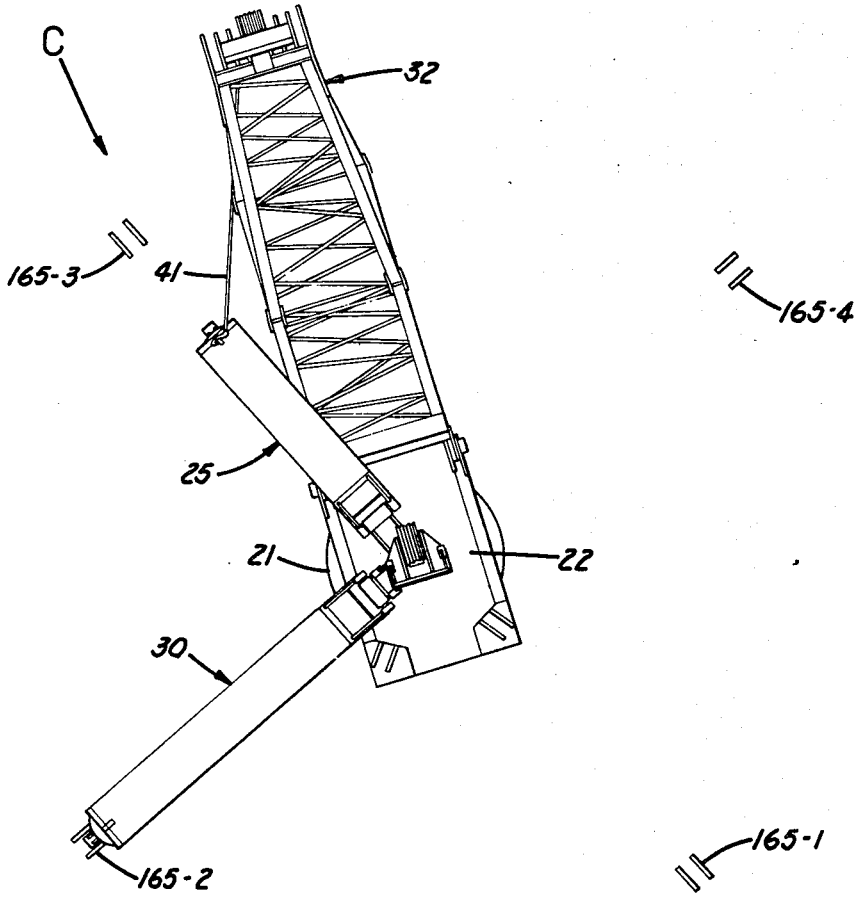
FIG. 10 is a top plan view similar to FIG. 9 illustrating the movement of the boom and lay leg counterclockwise to the new lay leg position.
Figure 11:
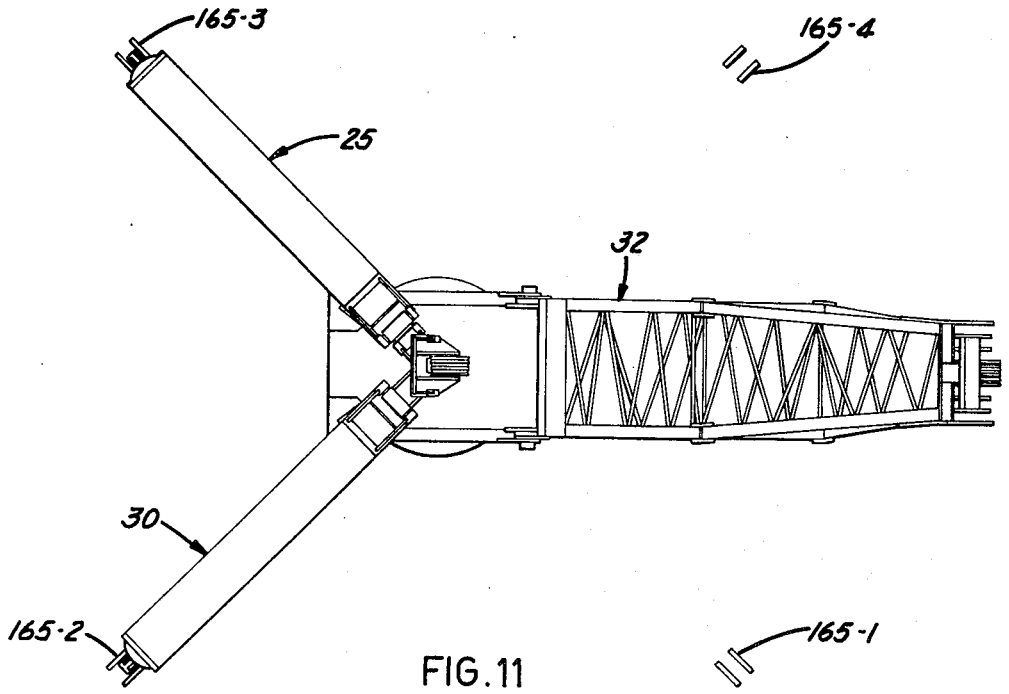
FIG. 11 is a top plan view similar to FIG. 10 showing the final lay leg positioning for operation of the boom in a new arc about the crane mast.

FIGS. 6–11, inclusive, illustrate several steps involved in relocating the crane lay legs to change the sweep of operation of the crane from the approximately 270° shown in FIG. 6 to that of FIG. 11. In FIG. 6 it will be apparent that the crane cannot operate in what shall be referred to as the southern quadrant or in other words the 90° about the crane at the bottom of the hypothetical circle about the crane. After relocation of the lay legs in the several steps described and illustrated, the crane as shown in FIG. 11 can then operate in all quadrants around the mast except what shall be referred to as the eastern quadrant. Referring to FIG. 6 the lay leg 25 is secured to the bracket 165-1 while the lay leg 30 is secured to the bracket 165-2. It is to be understood that while the parent structure is not illustrated, the brackets 165-1 and 165-2 are secured to portions of the parent structure as suggested in FIGS. 1 and 4, it being further understood that the parent structure is made up of members of a structural framework being erected with the crane. In the lay leg arrangement shown in FIG. 6, the crane may be said to be operable within the north, east, and western quadrants while being precluded from operating in the southern quadrant about the crane. The objective of the procedure to be described is to rearrange the lay legs to permit crane operation in the southern, western, and northern quadrants. The first step in rearranging the lay legs is the disengagement of the lower end of the lay leg 25 from the parent bracket 165-2. When the lay leg is disengaged, the lower end of the leg is tied with the line 41 hanging from the boom tip and the leg is retracted or telescoped to shorten the leg and the leg is folded inwardly along the mast as in FIG. 8. The line 41 is then disconnected from the leg. By operation of the geared arrangement shown in FIG. 3 the base 20, the mast 23, and the boom 32 are then rotated clockwise from the broken line position of FIG. 8 until the boom is in the solid line position shown in FIG. 8 while the leg is folded along the mast. The folding of the lay leg 25 inwardly close to the mast locates the leg at a position at which the boom foot and the brackets 151 may easily pass the lay leg as the boom and base are rotated clockwise. The leg end is then reconnected with the boom line 41 and the leg is pulled outwardly and engaged along an edge by an edge of the lower end of the boom as seen in FIG. 9. The boom is then rotated back counterclockwise from the position shown in FIG. 9 to the position of FIG. 10. With the line 41 from the boom still connected with the lay leg, the boom is maneuvered to swing the lay leg outwardly and upwardly as seen in FIG. 10 toward the bracket 165-3. The lay leg is then reextended and connected with the bracket 165-3 in the relationship shown in FIG. 11. The crane may then function in the north, east, and southern quadrants. It will be recognized that in extending the lay leg for connection with the bracket 165-3 gravity will assist in allowing the inner section of the lay leg to drop downwardly telescoping outwardly from the upper outer section while control is maintained by keeping the boom line 41 connected.

It will be recognized that the previously described procedure for relocation or repositioning of the lay legs may be followed to place the legs at any desired angle depending on the area around the crane in wihch it is desired to work the crane. For example, the lay leg 30 may be relocated from the position shown in FIG. 11 to connect the leg with the bracket 165-4 so that the western, southern, and eastern quadrants around the crane would be available for working the crane. The previously described steps may be sequentially followed to place the leg 30 at the new desired location. The capability of folding and retracting the legs permitting them to be positioned close to the mast where the boom may swing past the lay leg makes such relocation possible. While it is not absolutely essential, it is generally desirable that one of the legs be maintained secured to the parent structure while the other is being relocated. FIG. 1 illustrates the folded position of the lay leg 30 during the previously described steps where one of the lay legs is folded inwardly to move the boom past the leg. It will be apparent that the boom with the boom foot bracket on the base 20 may readily swing around the past the folded lay leg.

The extended lay leg arrangements illustrated and described in connection with FIGS. 6–11 are used where substantial loads are to be handled at substantial distances from the crane base and mast. A particular feature of the invention is the capability of operation without the connection of the lay legs to the parent or other supporting structure in the handling of light loads and in the operation of the boom raised upwardly near vertical so that the loads are handled close to the crane base. It will be understood, of course, that in such alternate operation with the lay legs pinned to the crane base there is a substantial reduction in the capacity of the crane. For example, it has been found that at a 12-foot operating radius the crane capacity with the lay legs pinned to the base is between one-third and one-half of the comparable capacity with the legs secured further outwardly to parent structure. At a 20-foot working radius with the lay legs pinned to the base the capacity has been found to be about one-fourth of the corresponding capacity with the legs extended farther outwardly to the parent structure. Another variable factor in such comparisons is the length of the boom. The example relationships given were determined with a 40-foot boom.

Figure 2:
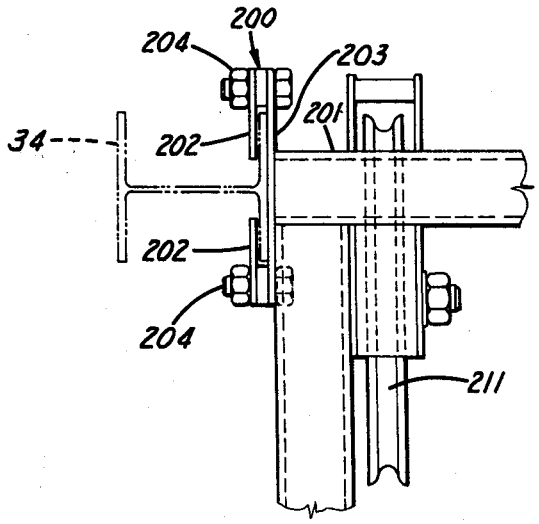
FIG. 2 is an enlarged fragmentary view taken along the line 2—2 of FIG. 1 showing the apparatus for supporting the crane and a subframe along guide rails of a parent structure.

The crane of the invention is especially adapted to self-relocation and to operation within a self-erecting tower. Arrangements for taking advantage of these features of the invention are illustrated in FIGS. 1, 2, and 12. FIGS. 1 and 2 show the use of guide rails 34 along the parent structure for raising and lowering the crane supported from a subframe 33. A guide bracket assembly 200 is connected by a frame 201 to the collar assembly 22 which is supported on the subframe 33. Another guide bracket 200 is secured with the lower end of the subframe. The bracket 200 is formed by back plates 202 and front plates 203 held together by bolt assemblies 204 so that the bracket assemblies slidably engage the flanges on the H beam shaped guide rail 34 allowing the subframe and crane base assembly to be raised and lowered along the parent structure. It will be obvious that at least two guide rails 34 are used with corresponding sets of the bracket assemblies 200 for supporting the crane from the parent structure. At each desired operating height the crane and base frame are suitably bolted or strapped to the parent structure guide rails to support the crane until relocation is desired. An arrangement is shown in FIG. 12 used with the crane to permit the crane to be self-supporting for raising and lowering the crane either in a self-erecting tower or from the parent structure as shown in FIG. 1. Referring to FIG. 12 a self-erecting tower 210 is illustrated which may be used to support the crane alongside a structure to be erected with the tower 210 providing a support for the crane, being erected by the crane, and permitting the crane to be raised and lowered by use of the boom line 41. The tower 210 comprises vertical and horizontal beams as illustrated along which are secured the vertical guide rails 34 to which the crane subframe 33 is slidably connected by the brackets 200 illustrated in more detail in FIG. 2. A pair of spaced sheaves 211 are secured with the sub frame while a line 212 is reaved around below the sheaves 211 over the hook 41*a* on the line 41 and connected at opposite ends with the members of the tower 210. Pulling upwardly on the line 41 will raise the crane C within the tower along the guide rails 34. The crane may similarly be lowered in the tower. As the crane is raised or lowered the boom lines are readily used for lifting and lowering structureal members of which the tower is formed. Thus as shown in FIG. 12 after the crane has been raised to the extent possible with the line arrangement shown it is locked in place and additional tower members are lifted from the ground to construct the tower another section higher after which the line 212 is relocated and the crane can climb to the next elevation upwardly. During this operation the lay legs are pinned as illustrated in FIG. 12 to the crane base. Such pinning of the lay legs inwardly and the arrangement of the boom in the substantially vertical position permits the operation of the crane within a self-erecting tower of minimum cross-sectional area. It will be apparent that such a minimum cross-sectional area also may be used within a parent structure so that the crane may be moved up through spaces of small dimension as the parent structure is being erected. The folding capability of the lay legs together with the rigidity of the non-self-aligning mounting of the mast in the crane base substantially enhances the self-climbing and lowering features of the crane. These latter discussed advantages of the crane of the invention of course complement the previously pointed out advantages of being able to relocate the lay legs at various desired angles around the crane for achieving full circle crane operation without the normal procedures required in conventional cranes.

What is claimed and desired to be secured by Letters Patent is:

1. A stiff leg crane comprising: an annular thrust bearing providing a rotatable support for said crane; a mounting means secured with said thrust bearing for mounting said crane on support structure; a crane base platform secured on said thrust bearing for rotation through 360° on said bearing; a vertical mast secured in a rigid non-pivoting relationship along a lower end thereof into said base platform and extending upwardly therefrom said mast having a longitudinal axis coincident with the axis of rotation of said base platform; a boom pivotally mounted at a foot end on said base platform and movable about a substantially horizontal axis at said foot end to any one of a plurality of angles between substantially vertical and below horizontal; means connected with said boom for raising and lowering said boom and supporting said boom at a desired angle of inclination; line means connected with said boom for supporting a load from the free end of said boom; and bracing means including a pair of lay legs each connected at upper ends thereof with said mast near the upper portion thereof for pivotal movement relative to said mast in vertical planes and for rotational movement around said mast whereby each of said lay legs may be positioned at any desired location in a circle around said mast and may be pivoted in vertical planes relative to said mast to any desired angular position relative to said mast for connection with support structure spaced from said base platform, said lay legs being adapted to fold inwardly along said mast for relative rotation between said lay legs and said mast, boom, and base platform without interference between said boom and said lay legs.

2. A crane in accordance with claim 1 wherein each of said lay legs is telescopically extendable and retractable for adjusting the length of each of said legs.

3. A crane in accordance with claim 2 including bracket means on said base platform for connection of the free ends of said lay legs with said base platform spaced from the base end of said mast.

4. A stiff leg crane comprising: crane mounting means for securing said crane on support structure; thrust bearing means secured on said mounting means; a crane base secured for rotation around a full circle on said thrust bearing means; a vertical mast supported rigidly in a non-pivotal relationship on said crane base with longitudinal axis of said mast being coincident with the axis of rotation of said crane base; a boom pivotally mounted a foot in on said crane base and being vertically movable about an axis in said foot end through an arc ranging from substantially vertical to below a horizontal position; boom support and control lines and load handling lines connected between the free end portion of said boom and an upper end portion of said mast for manipulating said boom in handling loads with said lines from said free end of said boom; at least two ring bearing assemblies secured around said mast near the upper end thereof and rotatable around said mast independently of each other; a pivot connection secured with each of said ring bearing assemblies; a lay leg secured with each of said pivot connections whereby each of said lay legs is movable to pivot in a vertical plane including said mast between a first folded position along said mast to an angular position extending downwardly and outwardly from said mast providing a brace for said mast, each said lay leg being a telescoping adjustable assembly adapted to be extended and retracted for securing at a plurality of locations spaced from said mast and crane base independently of said crane base; means on the outer free end of said lay legs for connecting each of said lay legs with support structures spaced from said crane base; and said foot end of said boom being spaced from the lower end of said mast to permit relative rotation of said mast, said crane base, and said boom past each of said lay legs when said lay legs are folded inwardly along said mast without interference with said lay legs; and bracket means on said base frame for securing the lower free ends of said lay legs with said base frame at a location spaced from the base end of said mast.

5. A crane in accordance with claim 3 including a subframe connected with said mounting means; guide brackets connected with said sub-frame for securing said crane with and moving said crane vertically along an adjacent structure; and sheave means secured with said base frame and said mounting means for a line from said boom to said adjacent structure reeved to permit said crane to be raised and lowered by operation of said line from said boom.

6. A crane in accordance with claim 5 wherein said adjacent structure comprises a support tower adapted to be assembled and disassembled by said crane, said support tower having vertical guide rails engageable by said guide brackets on said sub-frame.

7. A stiff-leg crane comprising: a collar assembly forming a mounting frame for said crane; an annular thrust bearing secured on said collar assembly; a crane base platform mounted on said thrust bearing for rotation around a full circle on said thrust bearing; means connected with said collar assembly and said thrust bearing for rotating said base platform to turn said crane to any desired position of rotation on said thrust bearing; a vertical mast mounted in a rigid non-pivotal relationship along the lower end portion in said base platform; a boom pivotally mounted on a horizontal axis at a foot end thereof spaced from the base end of said mast; an angular brace assembly extending from said base platform upwardly to an upper portion of said mast along a side of said mast opposite from said boom base end; at least two rotatable bearing assemblies on an upper end portion of said mast, said bearing assemblies being adapted to rotate around said mast independently of each other; a pivot connection on each of said bearing assemblies; a lay leg brace connected at an upper end thereof with each of said pivot connections whereby said lay leg brace may pivot in a vertical plane aligned with said vertical mast and is movable from the folded position along said mast outwardly to an angular position for supporting said mast from structure independent of said base platform spaced from the lower end of said mast, each of said lay legs being a telescoping extendable and retractable assembly having means on the outer end thereof for connection with adjacent supporting structure; bracket means on said crane platform spaced from the lower end of said mast for connection of each of said lay legs with said base platform; foot end of said boom and said lower end of said mast being spaced sufficiently to permit relative rotation of said mast, base platform and boom and each of said lay legs when each of said legs is folded inwardly along said mast; means connected between said upper end of said mast and the free end of said boom for raising and lowering said boom and supporting said boom at a desired angle of inclination; and means connected with said boom for handling loads from the free end of said boom.

8. A crane in accordance with claim 7 wherein said mast is hollow and including sheave means at the upper end of said mast and below the lower end of said mast within said collar assembly for load handling and boom control lines extending upwardly through said collar assembly, said mast, and to said free end of said boom.

9. A crane in accordance with claim 8 including subframe means connected with said collar assembly for supporting said crane; guide bracket means on said sub-frame means and said collar assembly for slidably connecting said frame with adjacent support structure having vertical guide rails engageable by said guide bracket means; and sheave means connected with said collar assembly for a line running between said adjacent structure and connected with a handling line from said boom whereby said crane is raised and lowered along said support structure by manipulation of said handling line from said boom.

* * * * *